US005364079A

United States Patent [19]

Gruber et al.

[11] Patent Number: 5,364,079

[45] Date of Patent: Nov. 15, 1994

[54] TILTABLE CONVERTER

[75] Inventors: Rudolf Gruber; Rupert Berger; Bernhard Enkner, all of Linz; Gerhard Losbichler, St. Marien, all of Austria

[73] Assignee: Voest-Alpine Industrieanlagenbau GmbH, Linz, Austria

[21] Appl. No.: 115,301

[22] Filed: Aug. 31, 1993

[30] Foreign Application Priority Data

Sep. 4, 1992 [DE] Germany ..... 9211926

[51] Int. Cl.[5] ..... C21C 5/50

[52] U.S. Cl. ..... 266/246; 266/245

[58] Field of Search ..... 266/245, 246, 247, 243, 266/287

[56] References Cited

U.S. PATENT DOCUMENTS

| | | | |
|---|---|---|---|
| 3,497,197 | 2/1970 | Osterr | 266/246 |
| 3,652,071 | 3/1972 | Gruber | 266/247 |
| 4,426,069 | 1/1984 | Nugati | 266/246 |

FOREIGN PATENT DOCUMENTS

| | | | |
|---|---|---|---|
| 0385772 | 5/1988 | Austria . | |
| 2433048 | 2/1980 | France . | |
| 0106888 | 7/1974 | Germany . | |
| 2931671 | 2/1980 | Germany . | |
| 2739540 | 11/1983 | Germany . | |
| 0071321 | 4/1983 | Japan | 266/246 |
| 1520108 | 11/1989 | Russian Federation | 266/246 |
| 1183732 | 3/1970 | United Kingdom . | |
| 1322590 | 7/1973 | United Kingdom . | |
| 2027858 | 1/1984 | United Kingdom . | |
| 2156058 | 10/1985 | United Kingdom . | |

*Primary Examiner*—Scott Kastler

*Attorney, Agent, or Firm*—Hopgood, Calimafde, Kalil & Judlowe

[57] ABSTRACT

A tiltable converter arrangement is disclosed in which a converter vessel is supported by a carrying ring surrounding and spaced from the converter. The carrying ring includes two diametrically oppositely arranged carrying trunnions. The converter is supported within the carrying ring by a plurality of guide rods, the converter being movable in the upright position. Each of the guide rods is designed as a pendulum rod each have a first end and a second end in which the first end is connected to the carrying ring by means of a spherical bearing and the second end connected to the converter vessel also by means of a spherical bearing, such as to provide an articulate universal joint between the carrying ring and the converter vessel.

25 Claims, 3 Drawing Sheets

TILTABLE CONVERTER

The invention relates to a tiltable converter comprising a carrying ring surrounding the converter vessel at a distance and including two carrying trunnions arranged diametrically opposite each other, the converter vessel being supported on the carrying ring exclusively by means of guide rods.

BACKGROUND OF THE INVENTION AND THE PRIOR ART

A tillable converter of this type is known, for instance, from DE-C-27 39 540 and from DE-A-29 31 67 1. With these known conveyers, the convertor vessel is supported on the carrying ring surrounding the same, by means of guide rods configured, at least partially, as so-called "triangular guide rods", wherein a triangular guide rod is meant to be a guide rod that is hinged either to the converter vessel or to the carrying ring at one end by means of two spaced-apart spherical bearing and to the carrying ring or the converter vessel, respectively, at its other end by means of a single spherical bearing.

Due to this type of configuration of the guide rods, in particular due to unavoidable deformations of the converter vessel, unforeseeable and uncalculatable forces are created stressing the guide rods not only by tension or pressure, but also by bending. The introduction of force both into the carrying ring and into the converter vessel is not precisely determined such that an excessively high stress may additionally be exerted on the guide rods.

Add to this that, due to the arrangement of the known guide rods both on the upper and on the lower sides of the carrying ring, the guide rods arranged on the upper side of the carrying ring, in addition, are subjected to a high thermal load. Further difficulties may arise due to ejections or overfoaming slag. Therefore, it is necessary with the known constructions to cover the guide rods arranged on the upper side of the carrying ring, which, in turn, involves difficulties in inspection and maintenance work. Moreover, the arrangement of the guide rods on the upper side of the carrying ring involves difficulties in the structural design of a slag protection means.

OBJECT OF THE INVENTION

The invention aims at avoiding these disadvantages and difficulties and has as its object to provide a tillable converter of the initially described kind, with which the introducton of force is clearly determined, in particular, if deformations of the converter vessel and of the carrying ring or thermal expansions of the same occur. The design of the guide rods functioning as force introduction elements between the converter vessel and the carrying ring is to be as simple as possible; the guide rods should have to absorb forces in one direction only, i.e., for all tilting positions of the converter. In addition, the force introduction elements are to be protected against the rough steelworks operation without requiring special constructional measures.

SUMMARY OF THE INVENTION

In accordance with the invention, this object is achieved in that each of the guide rods is designed as a pendulum rod, which is connected with the carrying ring by one end and with the converter vessel by its other end, by means of a spherical bearing in a universally articulated manner, the pendulum rods being arranged exclusively on the lower side of the carrying ring with the converter vessel in the upright position.

A statically perfectly determined mounting of the converter vessel in the carrying ring is characterized in that at least six pendulum rods are provided.

If need be, it may be advantageous if at least seven pendulum rods are provided to fasten the converter vessel on the carrying ring. Hence results a single-static indeterminancy of the mounting system, which, however, has the advantage that the bearing forces can be safely transmitted in any tilting position even if one bearing element has failed completely.

Preferably, one pendulum rod is each provided in the region of each carrying trunnion, which pendulum rod is directed approximately parallel to the plane formed by the carrying ring and approximately at a right angle to the tilting axis of the converter vessel, formed by the carrying trunnions, the forces occurring in the tilted position of the converter, thus, being introducible into the carrying trunnions as directly as possible and the carrying ring, thus, remaining largely unstressed.

In this case, the pendulum rods suitably are arranged to be oppositely directed in the peripheral direction of the converter vessel in the region of the carrying trunnions, wherein the centers of the spherical bearings of these pendulum rods, arranged on the converter vessel, are located in the plane laid through the tilting axis formed by the carrying trunnions and through the longitudinal axis of the converter vessel.

To absorb driving and oscillation forces in the direction of the tilting axis, a pendulum rod oriented approximately parallel to the plane of the carrying ring advantageously is arranged approximately centrally between the two carrying trunnions, wherein the center of the spherical bearing of this pendulum rod, arranged on the converter vessel, is located in or closely beside the central plane directed perpendicular to the tilting axis of the converter vessel.

With the converter in the upright position, the forces transmitted from the converter vessel onto the carrying ring suitably are transmitted by the remaining pendulum rods arranged approximately parallel to the longitudinal axis of the converter vessel.

In order to be able to introduce the forces into the carrying trunnions as close to the same as possible, with the arrangement of seven pendulum rods the pendulum rods oriented approximately parallel to the longitudinal axis of the converter vessel advantageously are provided as close to the carrying trunnions as possible, preferably in an angular region ranging between 25 and 45°, the angle being measured departing from the tilting axis in the ground section of the converter vessel.

With the arrangement of six pendulum rods, one of the pendulum rods oriented approximately parallel to the longitudinal axis of the converter vessel suitably is arranged approximately centrally between the carrying trunnions, i.e., in the plane laid through the longitudinal axis of the converter vessel perpendicular to the tilting axis, and the two other pendulum rods are provided as close to the carrying trunnions as possible, preferably in an angular region ranging between 25 and 45°, the angle being measured departing from the tilting axis in the ground section of the vessel.

A preferred embodiment is characterized in that the bearings comprise pins passing through the pendulum rods, each pin being supporting on the converter vessel and on the carrying ring, respectively, on both sides of the pendulum rod via supporting brackets, which supporting brackets preferably are welded to the converter vessel and are connected with the carrying ring, respectively, preferably by means of a screw connection.

In order to achieve a cushioning effect and to eliminate extreme stress peaks, the screw connection, in this case, is designed as an expansion screw connection, the expansion screws suitably extending over the total height of the carrying ring.

If a carrying ring cooling is provided, the expansion screws advantageously are inserted in sleeves arranged in the interior of the carrying ring and sealed relative to the residual cavity of the carrying ring.

Preferably, the pins also are spherically mounted in the supporting brackets.

In the following, the invention will be explained in more detail by way of two, exemplary embodiments illustrated in the drawing, wherein:

DETAILS OF THE INVENTION

Figure 1:
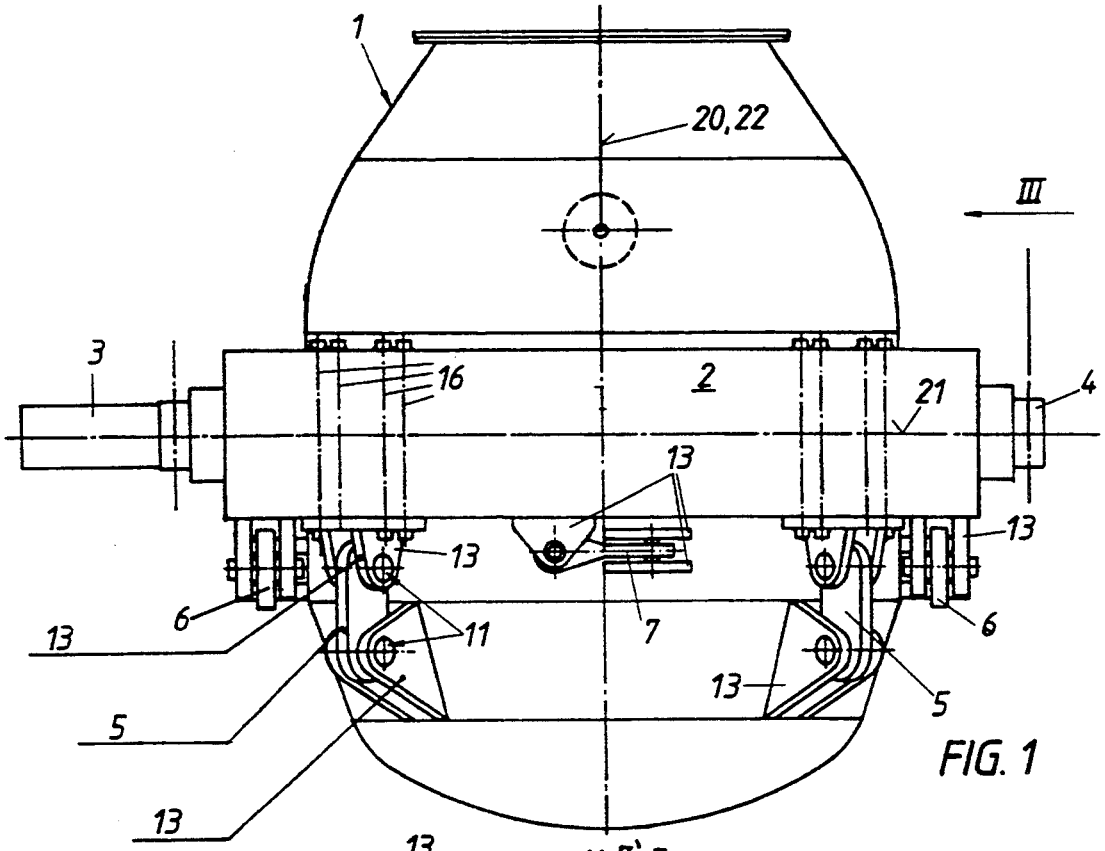
FIG. 1 is a front view of a converter.

By 1 a converter vessel is denoted, which is surrounded by a closed carrying ring 2 having a box-type or rectangular section. The carrying ring 2 is tiltably mounted in supporting bearings (not illustrated) by means of two diametrically arranged and aligned carrying trunnions 3, 4. At least one of the carrying trunnions 3, 4 is connected with a tilting drive.

Pendulum rods 5, 6, 7 serve to fasten the converter vessel 1 to the carrying ring 2, which—with the converter in the upright position—are arranged exclusively on the lower side of the carrying ring 2. Each of the pendulum rods 5, 6, 7, by one end 8 is connected with the carrying trunnion or ring 2 via a spherical bearing 9 and by its other end 10 is connected with the converter vessel 1 also via a spherical bearing 9, in a universally articulated manner. Each of the bearings 9 comprises a pin 11 passing through the pendulum rod 5, 6, 7 and mounted on the pendulum rod 5, 6, 7 via the spherical bearing 9.

The two ends 12 of each pin protruding laterally beyond the bearing 9, each are supported via supporting brackets 13 fastened to the carrying ring 2 and to the converter vessel, preferably also via spherical bearings 14.

The supporting brackets 13 allocated to the converter vessel 1 preferably are welded to the same, while the supporting brackets 13 allocated to the carrying ring 2 are connected with the same via a screw connection 15 (FIG. 3), preferably via an expansion screw connection, the expansion screws 16 (FIGS. 1 and 3) passing through the cavity or hollow space of the carrying ring 2 as far as to its upper side. Within the carrying ring, the expansion screws 16 each are surrounded by a sleeve 17 (FIG. 3), an pass through the sleeve, which sleeve, at the same time, serves as a seal against a coolant circulating within the carrying ring 2. The ends 18 of the expansion screws 16 (FIG. 3), located opposite the supporting brackets 13 are supported on the upper chord 19 of the carrying ring 2.

Figure 2:
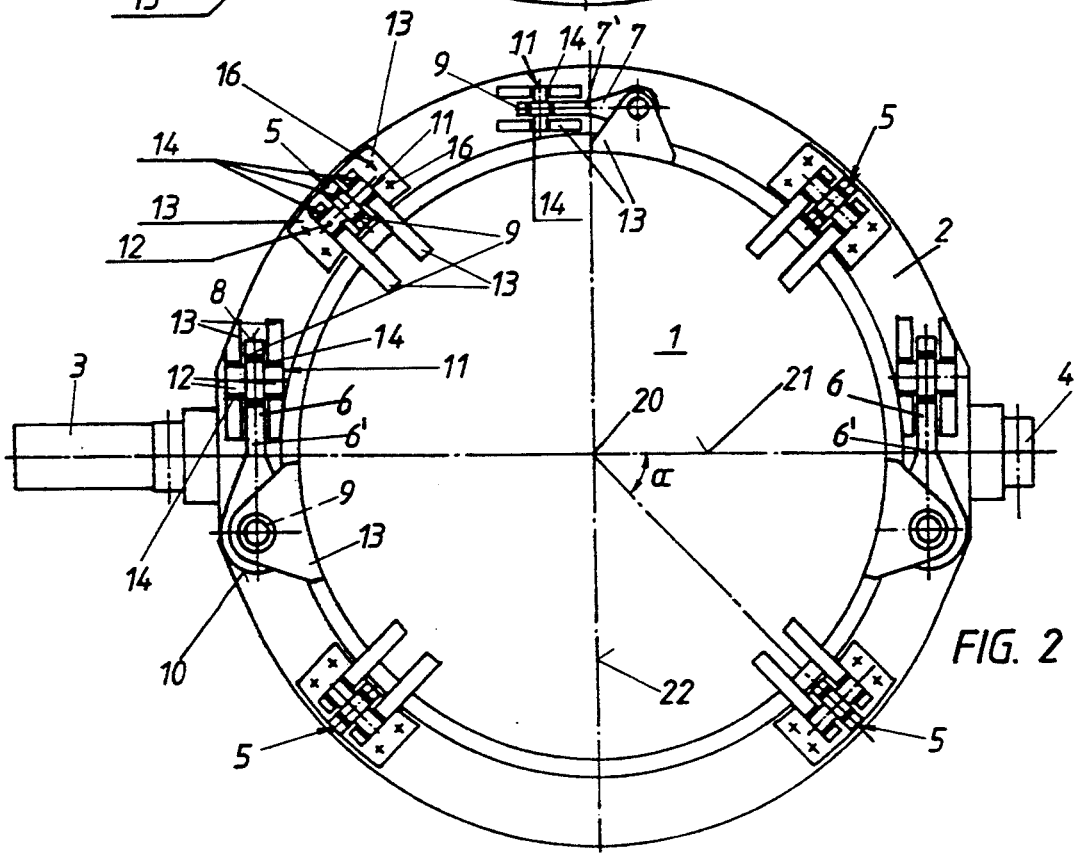
FIG. 2 is a bottom view of the same.
Figure 3:
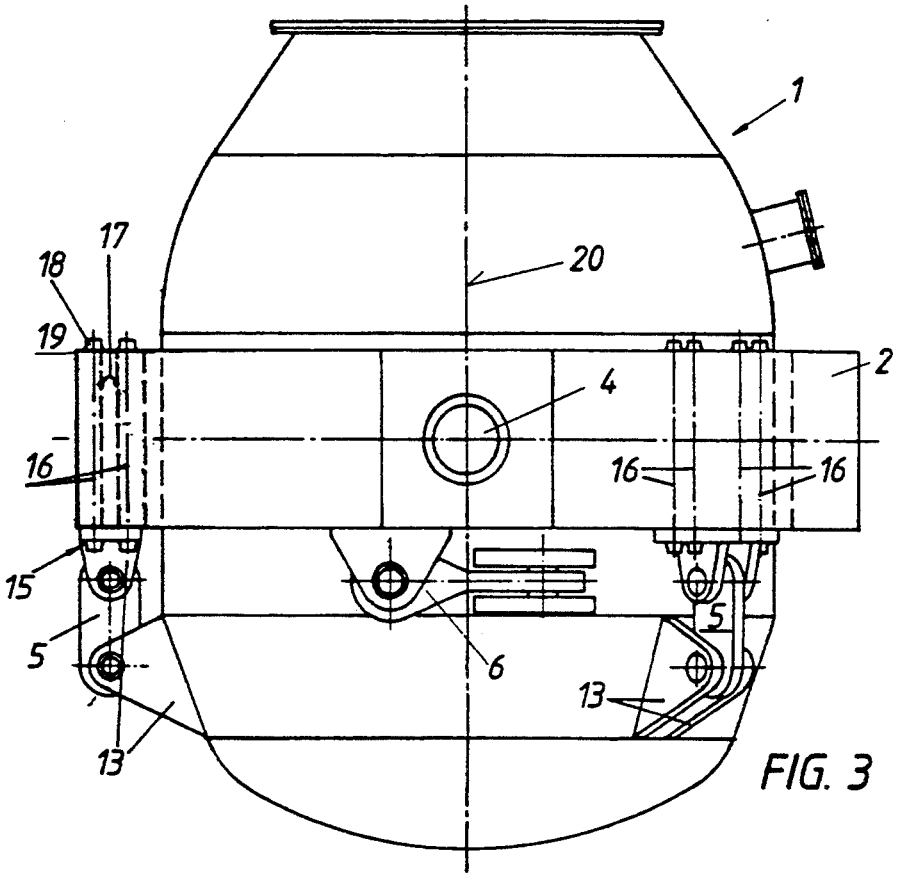
FIG. 3 is a partial section view in the direction of the arrow III of FIG. 1, and FIGS. 4, 5 and 6 depict another embodiment in illustrations analogous to FIGS. 1 to 3.

According to the embodiment illustrated in FIGS. 1 to 3, a total of seven pendulum rods 5, 6, 7 are provided. Thereby, the system is single-statically undetermined, :yet this redundancy of support has the advantage that, in case of a complete failure of a supporting element (pendulum rod 5, 6 7), the bearing forces still will be able to be safely transmitted in any tilting position. Another advantage results from the fact that converter vessels, according to experience, are deformed symmetrical, or approximately symmetrical, relative to the charging side/tapping side axis. Due to the single-static indeterminancy, very slight constraining forces occur, possibly on account of the deformations of the converter vessel, with the arrangement of line pendulum rods chosen according to FIGS. 1 to 3, thus eliminating existing bearing plays of the spherical bearings—which are minimal (about 0.3 to 0.5 mm)—by distortion.

Figure 5:
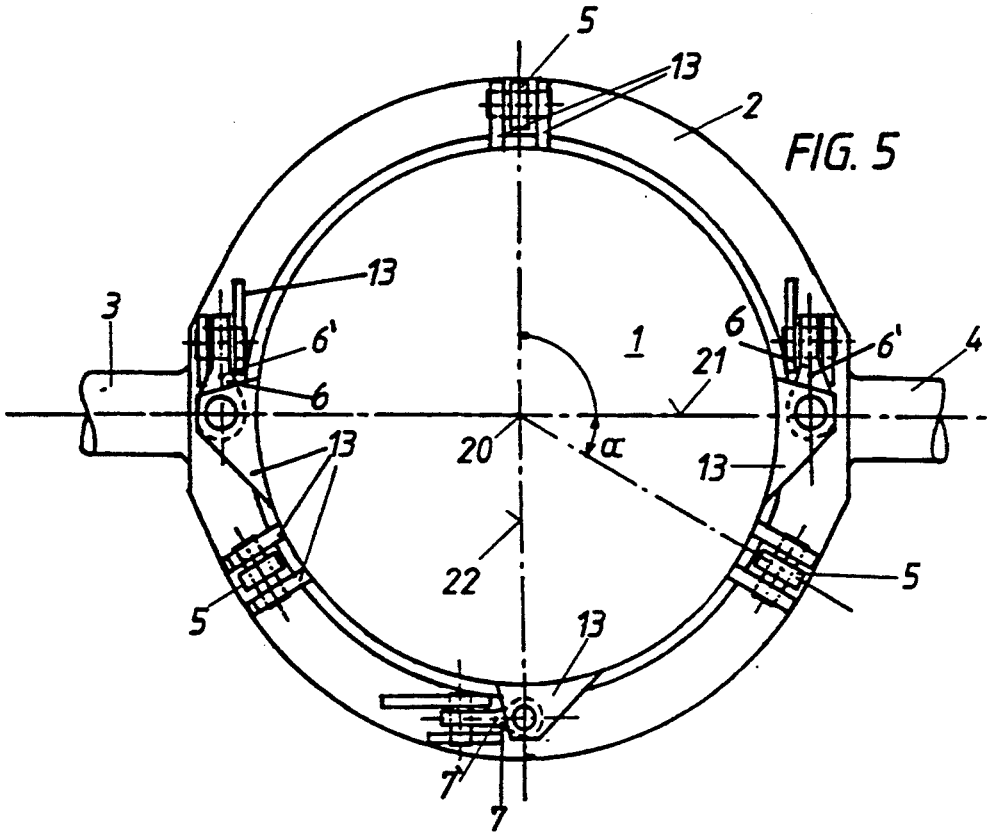

Four pendulum rods 5 of the total of seven pendulum rods 5, 6, 7 serve to absorb the forces of the converter vessel 1 in its upright position illustrated in FIGS. 1 to 3. These four pendulum rods 5 are oriented approximately parallel to the longitudinal axis 20 of the converter vessel 1, their arrangement along the periphery of the converter vessel I being chosen such that they are located as close to the carrying trunnions 3, 4 as possible. Preferably, they are arranged in an angular region of between 25 and 45°, the angle $\alpha$ being measured in ground or plan section, as shown in FIGS. 2 and 5; departing from the tilting axis 21 formed by the carrying trunnions 3, 4, and the apex of the angle being located in the center of the converter vessel 1.

Two pendulum rods 6 of the pendulum rods 5, 6, 7 are arranged in a manner that they serve primarily to absorb the forces occurring with the converter tilted about 90°. These two pendulum rods 6 each are arranged immediately below the carrying trunnion 3, 4 (FIG. 1); the longitudinal axes 6' (FIG. 2) of the pendulum rods 6 extend approximately in the plane of the carrying ring, i.e., approximtely horizontal with the converter in the upright position, and, furthermore, approximately at a right angle to the tilting axis 21 of the converter vessel 1 or slightly inclined relative to the converter vessel 1.

The moments which, with the converter tilted, result from that the center of gravity of the converter is not located on the supporting line of the two last-mentioned pendulum rods 6 are absorbed by the first four pendulum rods 5.

Finally, a pendulum rod 7 of secondary importance is provided, which serves to absorb driving and oscillation forces and whose longitudinal axis 7' is oriented approximately parallel to the plane of the carrying ring and approximately parallel to the tilting axis 21 of the converter vessel 1. It is located approximately centrally between the carrying trunnions 3, 4, wherein the spherical bearing 9 of this pendulum rod, which is allocated to the converter vessel 1, is arranged closely beside the plane 22 laid perpendicular to the tilting axis 21 and through the longitudinal axis 20 of the vessel.

Figure 6:
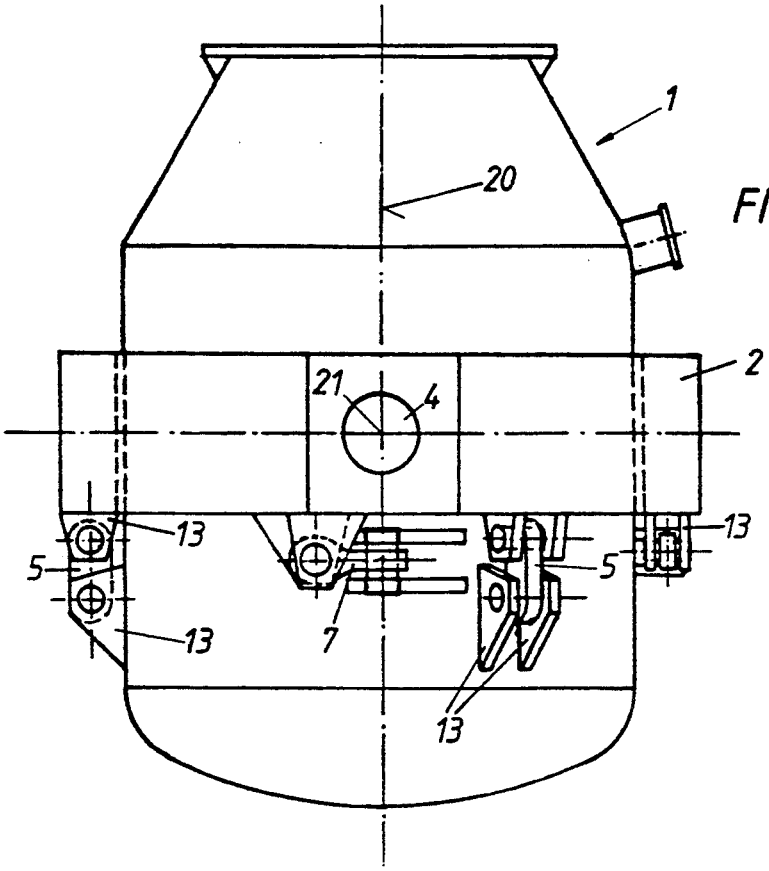
Figure 4:
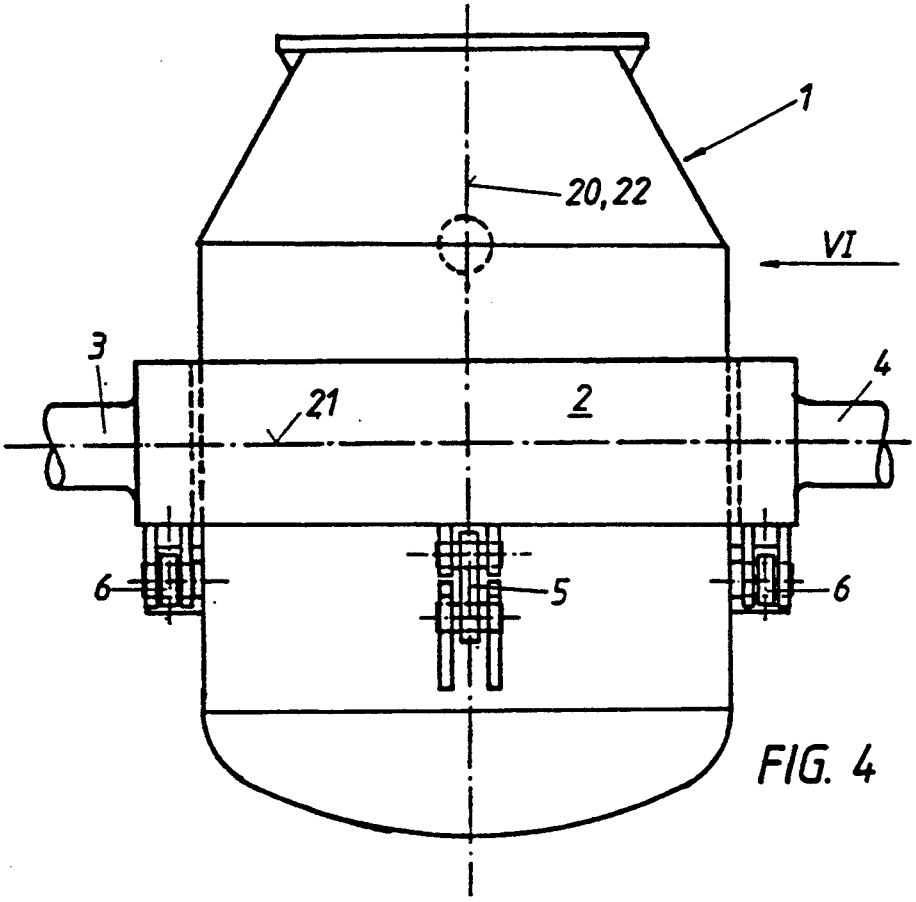

The embodiment of a tiltable converter illustrated in FIGS. 4 to 6 is characterized in that the support of the converter vessel 1 on the carrying ring 2 is statically determined, since only six pendulum rods 5, 6, 7 are provided. In this case, only three pendulum rods 5 are provided, extending approximately parallel to the longitudinal axis 20 of the converter vessel 1, one of the pendulum rods 5 being arranged centrally between the carrying trunnions 3, 4, i.e., in the plane 22 disposed perpendicular to the tilting axis 21 and through the longitudinal axis 20 of the converter vessel 1. The two other pendulum rods 5 oriented approximately parallel to the longitudinal axis 20 of the converter vessel 1 are provided as close to the carrying trunnions 3, 4 as possible. As is apparent from FIG. 5, the three pendulum rods 5 oriented approximately parallel to the longitudinal axis 20 of the converter vessel 1 are distributed approximately uniformly about the periphery of the converter vessel 1.

The structure according to the invention has the following advantages:

Clearly defined bearing forces between the converter vessel 1 and the carrying ring 2 in any tilting position, since the static determinancy (in particular with only six pendulum rods 5, 6, 7) for a three-dimensional support in combination with a symmetric deformation is consistently fulfilled.

Free expansion possibility for practically all of the deformations of the converter vessel 1 and of the carrying ring 2.

Due to the arrangement of the spherical bearings 9, expansion is only extremely slightly impeded, even with poor maintenance, since a pendulum rod 5, 6, 7 that is displaced by one end 8, 10 opposes the displacement only by the friction in the bearings 9 against rotation.

The direction of force for the introduction of forces into the converter vessel 1 is precisely determined, not changing with the tilting position. For this reason, the pendulum rods 5, 6, 7 need to be designed for one direction of force only. With other known suspension systems, any stress exerted always is a combination of horizontal and vertical loads changing with the tilting angle.

The gap between the converter vessel 1 and the carrying ring 2 may be reduced to the still reasonable minimum determined by the deformations. This may be of decisive importance to modifications of existing steelwoks where the position of supporting bearings and the diameters of converters are preset.

All of the suspension elements are arranged in the coolest zone of the converter and are well protected against ejections and overfoaming slag.

Since no superstructures are necessary on the upper side of the carrying ring, the structural design of the slag protection means on the converter upper part and on the upper side of the carrying ring are simple to realize.

Since all of the suspensions elements come to lie on one side of the carrying ring 2, this means simplified mounting as compared to other suspension systems comprising elements on the upper and lower sides of the carrying ring, since the carrying ring 2 can be put onto the converter vessel 1 from above without being impeded by suspension elements.

The suspension elements only cover relatively small regions of the gap between the converter vessel 1 and the carrying ring 2, and thereby provide a good air circulation which favorably produces a cooling effect on the converter 1.

The suspension requires only little maintenance expenditures, no readjustment work and is insensitive to insufficient greasing.

The fastening of the supporting brackets 13 to the carrying ring 2 by means of long expansion screws 16 provides an excellent cushioning effect.

The invention is not limited to the exemplary embodiments illustrated, but may be modified in various aspects. This holds for the configuration of the spherical bearings, which do not necessarily require pins passing through the pendulum rods. Other constructions may be envisaged as well.

Furthermore, the number of pendulum rods is not necessarily restricted to six or seven. There could be provided even more pendulum rods; for instance, an add additional pendulum rod to each of the pendulum rods 5 and 6 of the embodiment illustrated in FIGS. 4, 5 and 6, serving as an additional safety means.

What we claim is:

1. In a tiltable converter arrangement comprising a converter vessel having a longitudinal axis, including a carrying ring surrounding and spaced from said converter vessel, said carrying ring disposed in a plane and having an upper side and a lower side and including two diametrically oppositely arranged carrying trunnions therefor, and a plurality of guide rods, said converter vessel being supported on said carrying ring exclusively by said plurality of guide rods, said converter being movable to an upright position, the improvement wherein each of said guide rods is designed as a pendulum rod having a first end and a second end, wherein a first spherical bearing means is provided to connect said first end with said carrying ring and wherein a second spherical bearing means is provided connecting said second end with said converter vessel, thereby providing an articulated universal joint therebetween, said pendulum rods being spaced one from the other and disposed solely on the lower side of said carrying ring relative to said converter vessel in the upright position.

2. A converter arrangement as set forth in claim 1, wherein at least six pendulum rods are provided.

3. A converter arrangement as set forth in claim 1, wherein at least seven pendulum rods are provided.

4. A converter arrangement as set forth in claim 1, wherein one pendulum rod is each provided in the region of each of said carrying trunnions, said one pendulum rod being disposed approximately parallel to the plane formed by said carrying ring and approximately at a right angle to the tilting axis of said converter vessel, formed by said carrying trunnions.

5. A converter arrangement as set forth in claim 4, wherein said pendulum rods arranged in the region of said carrying trunnions are arranged to be oppositely directed in the peripheral direction of said converter vessel, and wherein said spherical bearing means of said pendulum rods, arranged on said converter vessel, have their centers located in a plane passing through the tilting axis formed by said carrying trunnions and through the longitudinal axis of said converter vessel.

6. A converter arrangement as set forth in claim 1, wherein a central pendulum rod oriented approximately parallel to the plane of said carrying ring is provided approximately centrally between said two carrying trunnions, wherein the center of said spherical bearing means of said central pendulum rod, arranged on said converter vessel, is located in or closely beside a central plane disposed perpendicular to the tilting axis of said converter vessel.

7. A converter arrangement as set forth in claim 4, further comprising a central pendulum rod oriented approximately parallel to the plane of said carrying ring approximately centrally between said two carrying trunnions, wherein the center of said spherical bearing means of said central pendulum rod, arranged on said converter vessel, is located in or closely beside the central plane directed perpendicular to the tilting axis of said converter vessel, the remaining pendulum rods being arranged to be oriented approximately parallel to the longitudinal axis of said converter vessel.

8. A converter arrangement as set forth in claim 5, further comprising a central pendulum rod oriented approximately parallel to the plane of said carrying ring approximately centrally between said two carrying trunnions, wherein the center of said spherical bearing means of said central pendulum rod, arranged on said converter vessel, is located in or closely beside the central plane directed perpendicular to the tilting axis of said converter vessel, the remaining pendulum rods being arranged to be oriented approximately parallel to the longitudinal axis of said converter vessel.

9. A converter arrangement as set forth in claim 7, wherein seven pendulum rods are arranged and those which are oriented approximately parallel to the longitudinal axis of said converter vessel are arranged as close to said carrying trunnions as possible.

10. A converter arrangement as set forth in claim 9, wherein said pendulum rods arranged parallel to the longitudinal axis of the converter vessel are provided in an angular region ranging between 25 and 45°, the angle being measured relative to the tilting axis of said converter vessel in ground section thereof.

11. A converter arrangement as set forth in claim 8, wherein seven pendulum rods are arranged and those which are oriented approximately parallel to the longitudinal axis of said converter vessel are arranged as close to said carrying trunnions as possible.

12. A converter arrangement as set forth in claim 11, wherein said pendulum rods arranged parallel to the longitudinal axis of the converter vessel are provided in an angular region ranging between 25 and 45°, the angle being measured relative to the tilting axis of said converter vessel in ground section thereof.

13. A converter arrangement as set forth in claim 7, wherein six pendulum rods are provided, one of said pendulum rods being arranged approximately parallel to the longitudinal axis of the converter vessel and being located approximately centrally between said carrying trunnions in a plane passing through the longitudinal axis of said converter vessel and perpendicular to the tilting axis of said converter vessel, with two of said pendulum rods being provided as close to said carrying trunnions as possible.

14. A converter vessel as set forth in claim 13, wherein said two pendulum rods are provided in an angular region ranging between 25 and 45°, the angle being measured departing from the tilting axis of said converter vessel in ground section thereof.

15. A converter arrangement as set forth in claim 8, wherein six pendulum rods are provided, with one of said pendulum rods arranged approximately parallel to the longitudinal axis of the converter vessel and arranged approximately centrally between said carrying trunnions in a plane passing through the longitudinal axis of said converter vessel perpendicular to the tilting axis of said converter vessel, and the two other of said pendulum rods are provided as close to said carrying trunnions as possible.

16. A converter vessel as set forth in claim 15, wherein said two other of said pendulum rods are disposed in an angular region ranging between 25 and 45°, the angle being measured relative to the tilting axis of said converter vessel in ground section thereof.

17. A converter vessel as set forth in claim 1, wherein said spherical bearing means comprise pins passing through said pendulum rods, including a supporting bracket for supporting each of said pins on said converter vessel on both sides of each pendulum rod.

18. A converter vessel as set forth in claim 17, wherein said supporting bracket is welded to said converter vessel.

19. A converter vessel as set forth in claim 1, wherein said spherical bearing means comprise pins passing through said pendulum rods, including a supporting bracket for supporting each of said pins on said carrying ring on both sides of each pendulum rod.

20. A converter vessel as set forth in claim 19, wherein a screw connection means is provided to connect said supporting bracket with said carrying ring.

21. A converter arrangement as set forth in claim 20, wherein said screw connection means is comprised of expansion screws.

22. A converter arrangement as set forth in claim 21, wherein said expansion screws extend over the total height of said carrying ring.

23. A converter arrangement as set forth in claim 22, wherein said carrying ring has a carrying ring interior formed by a cavity, and further comprising sleeves inserted in said carrying ring interior and sealed relative to the remaining cavity, said expansion screws being inserted in said sleeves.

24. A converter arrangement as set forth in claim 17, wherein said pins mounted in said supporting brackets are spherically configurated.

25. A converter arrangement as set forth in claim 19, wherein said pins mounted in said supporting brackets are spherically configurated.

* * * * *